United States Patent [19]

Turner

[11] 4,163,306

[45] Aug. 7, 1979

[54] BOUNCE CRIMPER OUTLET APPARATUS

[75] Inventor: James H. Turner, Severn, Md.

[73] Assignee: Chevron Research Company, San Francisco, Calif.

[21] Appl. No.: 833,373

[22] Filed: Sep. 14, 1977

[51] Int. Cl.[2] ..... D02G 1/16

[52] U.S. Cl. ..... 28/254; 28/264

[58] Field of Search ..... 28/254, 264, 267, 262, 28/271, 289; 264/309

[56] References Cited

U.S. PATENT DOCUMENTS

| | | | |
|---|---|---|---|
| 3,296,677 | 1/1967 | Chase | 28/264 X |
| 3,665,567 | 5/1972 | Clarkson | 28/254 |
| 3,859,696 | 1/1975 | Guenther | 28/254 |

*Primary Examiner*—Louis Rimrodt

*Attorney, Agent, or Firm*—Dix A. Newell; T. G. DeJonghe

[57] ABSTRACT

An improved outlet apparatus for a bounce crimper is disclosed which includes a restrictor assembly provided with a bore and an internally mounted flat leaf spring. Extending beneath the leaf spring, a longitudinal slot may be provided through which a texturized multi-filament yarn of synthetic resinous material may be drawn in a reverse direction back into the restrictor assembly without entanglement and deformation of the flat leaf spring when the feed yarn is tangled.

4 Claims, 8 Drawing Figures

BOUNCE CRIMPER OUTLET APPARATUS

BACKGROUND OF THE INVENTION

This invention relates to bounce crimping apparatus for texturizing multi-filament yarns of synthetic resinous material. More particularly, the invention concerns an improved outlet apparatus for the bounce crimper.

In an earlier patent, U.S. Pat. No. 3,887,971, issued June 10, 1975, a bounce crimper with an outlet assembly was disclosed wherein the outlet assembly included a somewhat elongated, generally curved, outlet tube having a curved resilient finger near the discharge end of the tube to restrict passage of texturized multi-filament yarn. Subsequently, a proposal was advanced for a different form of outlet assembly which also included a resilient spring finger extending generally across the path of the discharging yarn.

Although these constructions work well as a general proposition, the yarn being fed to a bounce crimper will occasionally become entangled with the feed rolls and will be drawn rearwardly through the bounce crimper. In some such instances, the reversely moving yarn can become tangled on the restrictor spring and cause irreparable damage thereto.

SUMMARY OF THE INVENTION

An outlet apparatus in accordance with the present invention overcomes the problem discussed above.

To avoid damage to the restrictor spring finger when bounce crimped yarn is pulled back through the restrictor assembly by the feed rolls, the wall of the bore defining the yarn passage through the restrictor may be provided with a longitudinally extending slot that is positioned below the end portion of the leaf spring. The bounce crimped yarn moves into the slot when pulled backwards through the restrictor assembly, bypassing the spring and avoiding any damage thereto. Since the slot is narrow by comparison to the plug of bounce crimped yarn normally passing through the restrictor assembly, the slot does not affect normal operation.

BRIEF DESCRIPTION OF THE DRAWINGS

A more complete understanding of these and other features and advantages of the invention will be gained when this specification is read in conjunction with drawings wherein like reference numerals have been applied to like elements and wherein.

DESCRIPTION OF THE PREFERRED EMBODIMENT

Figure 1:
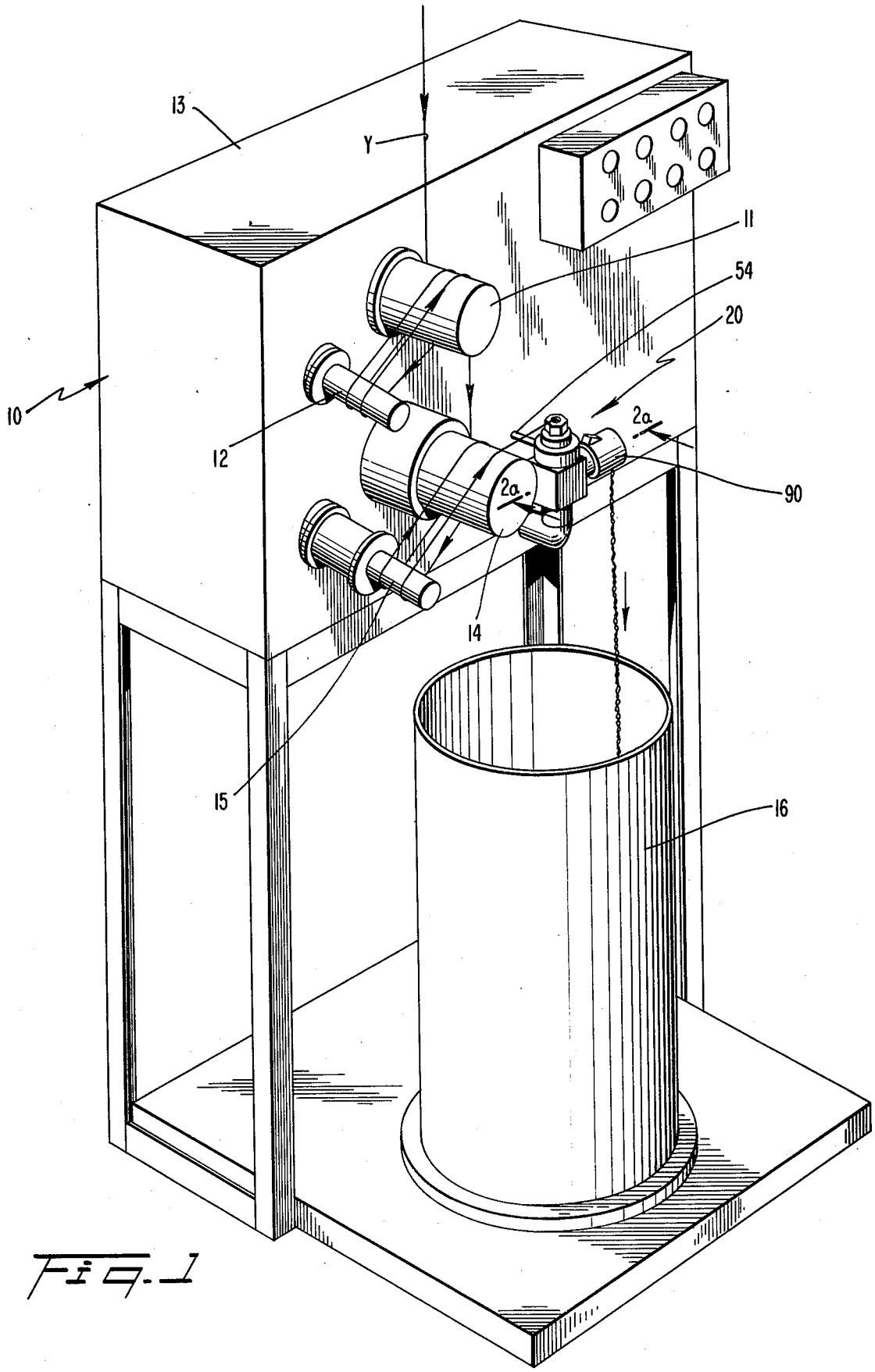
FIG. 1 is a pictorial view of a bounce crimping device.

Bounce crimping apparatus 10 (see FIG. 1) conventionally includes a first pair of rolls 11, 12 mounted on a frame 13. A multi-filament yarn Y of essentially continuous filaments of synthetic resinous material, such as polypropylene, is wrapped around the first pair of rolls 11, 12 and advances to a second pair of rolls 14, 15. The yarn Y is also wrapped around the second pair of rolls 14, 15 and then feeds into a bounce crimping head 20 in which the yarn is bounce crimped. As the bounce crimped yarn leaves the bounce crimping head 20 it may fall under the influence of gravity into a suitable collection container 16.

Figure 2A:
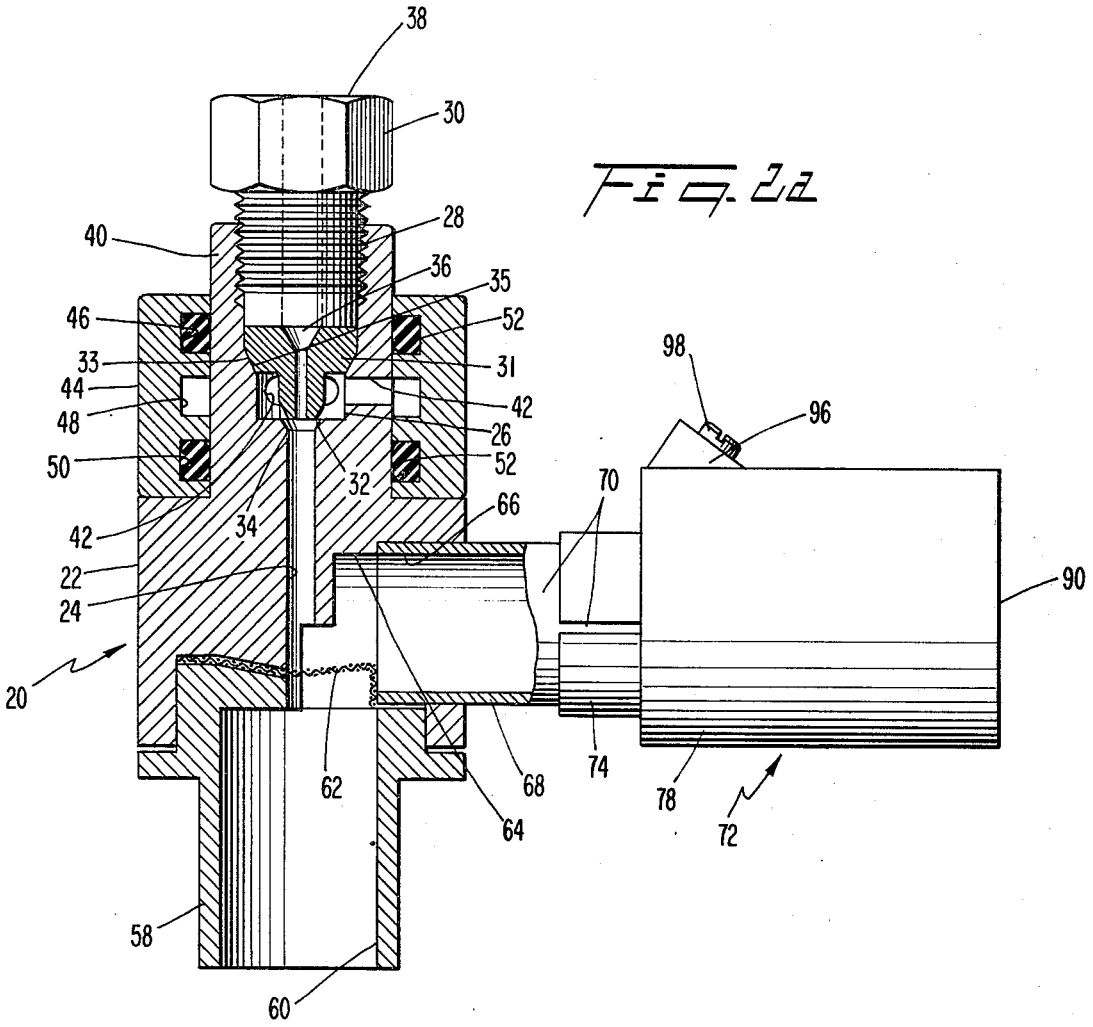
FIG. 2*a* is a partial cross-sectional view taken along the line 2*a*—2*a* of FIG. 1 through the bounce crimping head having an outlet assembly constructed in accordance with this invention.

The bounce crimping head 20 (see FIG. 2*a*) includes a body portion of housing 22 having a generally square cross section and a longitudinal bore 24 extending therethrough. The bore 24 includes an enlarged upper end 26 having an internally threaded section 28 that receives the externally threaded backing plug 30.

The bore also receives an orifice plug 31 that includes a frustoconical surface portion 32 on its distal end. The surface portion 32 cooperates with a second frustoconical surface 34 defined between the bore 24 and the enlarge portion 26 thereof to provide an annular orifice. The orifice allows fluid communication between the enlarged portion 26 and the longitudinal bore 24 past the orifice plug 31.

The orifice plug 31 is retained in the enlarged bore 26 by the backing plug 30. Mating frustoconical surfaces 33, 35 of the orifice plug 31 and the enlarged bore 26, respectively, are effective to longitudinally position and center the orifice plug 31.

Figure 2B:
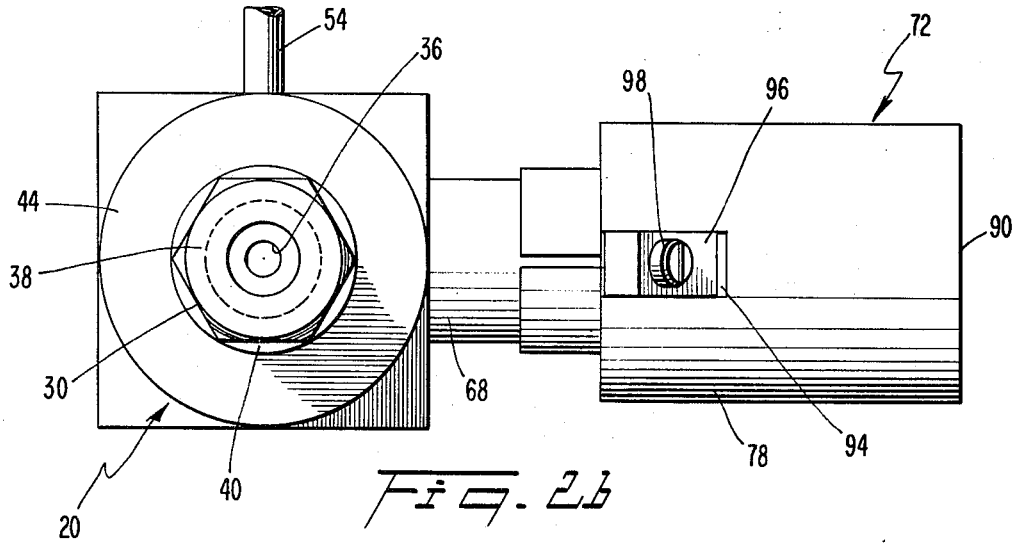
FIG. 2*b* is an elevational view of the bounce crimping head and outlet assembly.

The backing plug 30 and the orifice plug 31 include a channel or yarn inlet 36 which extends coaxially therethrough from the surface 38 (see FIG. 2*b*) of the backing plug 30 to the distal end of the orifice plug 31 downstream of the annular orifice. The channel 36 provides a passageway for a multi-filament yarn of untexturized synthetic resinous material which is to be bounce crimped.

The body portion 22 includes cylindrical end portion 40 (see FIG. 2*a*) within which the backing plug 30 is threaded. The cylindrical portion 40 has an annular cross section, extends upwardly from a location below the annular orifice and is provided with plurality of radially extending ports 42. Each port 42 communicates with the enlarged portion 26 of the longitudinal bore 24 upstream of the frustoconical surface 34.

A manifold block 44 is mounted circumferentially around the cylindrical end portion 40 and includes three annular recesses 46, 48, 50 in its inner bore. The upper and lower recesses 46, 50 are adjacent to corresponding ends of the manifold block 44 and each is adapted to receive a suitable conventional O-ring seal 52. Each seal 52 provides a pressure seal between the corresponding end of the manifold block 44 and the cylindrical end portion 40. In this manner, the centrally located recess 48 is sealed.

The central recess 48 is in general radial alignment with the ports 42 and communicates with a conduit 54 (see FIG. 2*b*) that may be connected to a suitable conventional source of heated pressurized gas (not shown), such as steam. Accordingly, the steam communicates with the central recess 48, the ports 42 and the enlarged bore 26 and is accelerated by the annular orifice.

At the lower end of the body portion 22 is an exhaust housing portion 58 which includes a longitudinally extending bore 60 that is in general coaxial alignment with the bore 24 extending through the body portion 22. Positioned between the body portion 22 and the exhaust housing portion 58 is a suitable conventional foraminous surface 62, which may, for example, be a screen. The body portion 22 includes a lateral discharge of yarn outlet opening 64 substantially perpendicular to the bore 24. The discharge opening 64 communicates with the bore 24 above the foraminous sheet 62 and also communicates with one end 66 of a straight tubular conduit means 68.

The tubular conduit means 68 is constructed to be straight so that deposits of chemicals and contaminants which accumulate therein can be readily removed when the conduit means 68 is disassembled from the bounce crimping device. Moreover, the tube 68 is kept quite short, consistent with the need for a restricted passage of sufficient length to provide a consolidated body of yarn out of the way of the actual bounce crimping action. For many operations a tube having a nominal diameter of one-half inch is suitable, and the length of the tube preferably is not greater than about five times the internal diameter thereof. A length-to-diameter ratio not greater than about three is even more preferable.

A second end 70 of the tubular conduit means 68 is received by a restrictor assembly 72 which controls the discharge of a texturized multi-filament yarn from the tubular means 68 as well as from the discharge opening.

Figure 3:
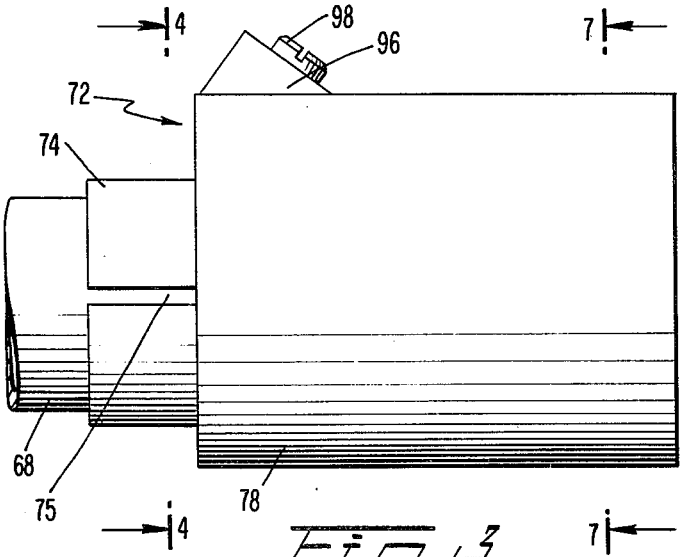
FIG. 3 is a side elevational view of the improved outlet in accordance with the present invention.
Figure 4:
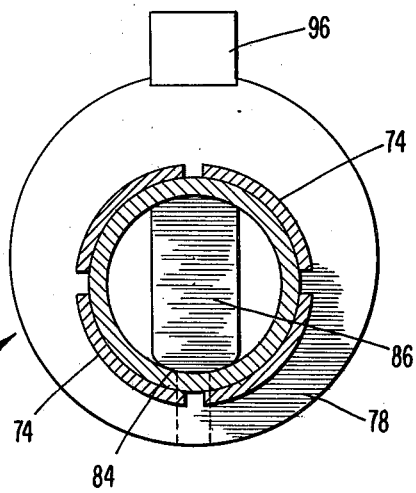
FIG. 4 is a partial cross-sectional view taken along the line 4—4 of FIG. 3.

As shown in FIG. 3 and FIG. 4, the restrictor assembly 72 includes a body or housing having a generally smooth substantially cylindrical configuration. At the inlet end of the restrictor assembly 72 (see FIG. 3), a plurality of fingers 74 extend outwardly and provide a receptacle to receive the second end 70 (see FIG. 2*b*) of the straight tubular conduit means 68. In cross section (see FIG. 4), the fingers 74 are substantially arcuate and are spaced from one another by a longitudinal slot 75 (see FIG. 3) which allows each finger to move independently of the adjacent fingers. The finger 74 may be circumferentially clamped onto the straight tubular conduit means 68 in a suitable conventional manner.

Figure 5:
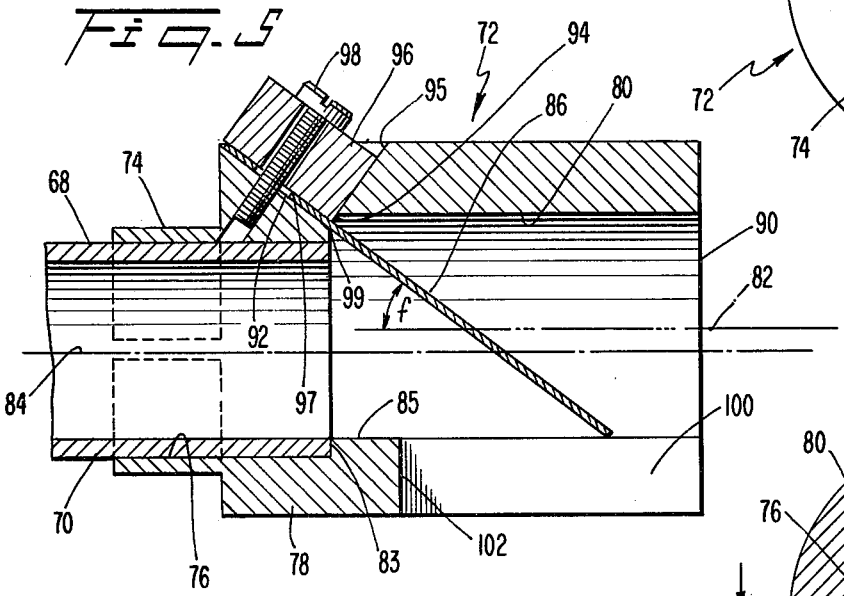
FIG. 5 is a partial cross-sectional view taken along the line 5—5 of FIG. 7.
Figure 7:
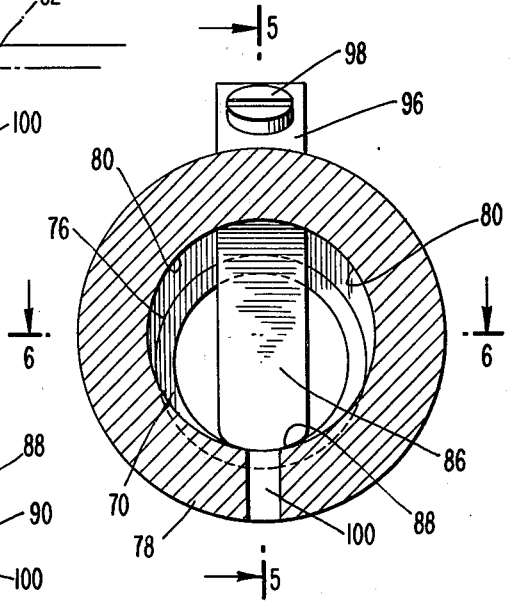
FIG. 7 is a view taken along the line 7—7 of FIG. 3.

The inside surface of each finger 74 (see FIG. 5) is an extension of a first cylindrical bore which extends into a restrictor body 78 of the restrictor assembly 72. The first bore 76 has an internal diameter corresponding to that of the second end 70 of the straight tubular conduit means 68. In this fashion, the end 70 of the tubular conduit is received by the bore 76 so that the restrictor assembly 72 may be suitably connected therewith.

The restrictor body 78 also includes another generally cylindrical bore 80 having an axis 82 which is offset, or eccentrically positioned, with respect to the axis 84 of the first cylindrical bore 76. The eccentric cylindrical bore 80 has a diameter greater than the diameter of the first bore 76. Moreover, the lateral distance between the corresponding axes 82, 84 is selected so that the surface of the second bore 80 will be offset relative to the first bore 76 to define an abutment shoulder 83 facing in a direction opposite to the direction of yarn movement and having a radial height no greater than the wall thickness of the tubular conduit end 70.

In the foregoing fashion, when the restrictor assembly 72 is mounted on the tubular end 70, the abutment shoulder 83 will prevent the end 70 from projecting into the body 78 beyond a predetermined distance. In addition, the second bore 80 has a surface portion 85 which is in general longitudinal alignment with the internal surface of the conduit means 68 with no protrusions therebetween so that no obstruction results to impede movement of bounce crimped yarn from the conduit means 68 to the restrictor means 72.

Figure 6:
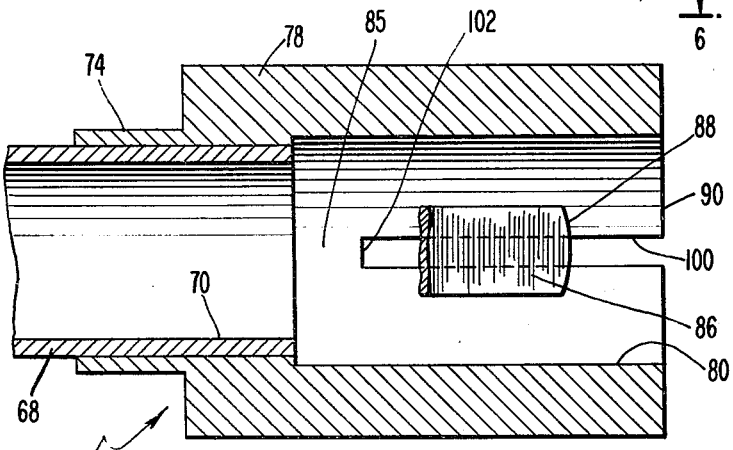
FIG. 6 is a partial cross-sectional view taken along the line 6—6 of FIG. 7.

In order to restrict the flow of bounce crimped multifilament yarn through the restrictor assembly 72, a leaf spring finger 86 is provided internally of the restrictor assembly 72. This spring is substantially flat in its unstrained condition, and it extends across and partially blocks the eccentric cylindrical bore 80 (see FIG. 4). The leaf spring 86 has a rounded end portion 88 (see FIG. 6) in general longitudinal alignment with the abutment surface 83 and juxtaposed to the surface portion 85. It will be noted that the rounded end 88 is positioned internally of the enlarged cylindrical bore 80 (see FIG. 5) and is remotely positioned from the discharge end 90 of the restrictor assembly 72. In fact, the length of the second bore 80 is selected so that the spring 86 does not protrude even when deflected by yarn passing through the bore 80.

A second end of the spring 86 rests against a substantially planar surface 92 that defines the rear side wall of a narrow slot 94 in the body housing 78. The slot 94 intersects the bore 80 at the location of a second shoulder 99 found at the juncture of the bores 76 and 80 facing in the opposite direction from the shoulder 83. The length of the slot 94 extends transverse to the axis of the bore 80. A complementary clamp member 96 (see FIG. 5) which may seat against the front side wall 95 of the slot 94 and which is releasably affixed to the body 78 by means of a threaded fastener 98. When the threaded fastener 98 is securely tightened, the clamp member 96 cooperates with the surface 92 to clamp the leaf spring 86 flat in position within the restrictor assembly 72. In addition, the leaf spring 86 includes an opening 97 through which the threaded fastener passes. The opening 97 is sized to allow the fastener to pass through easily but is small enough to accurately position the leaf spring.

Since the surface 92 is inclined relative to the axis 82 by a predetermined acute angle, the leaf spring 86 also assumes the predetermined acute angle relative to the axis 82. This inclination of the spring 86 cooperates with the second bore 80 to define a convergent passage through the restrictor assembly 72. Also, the illustrated clamping system disposes substantially the entire deflectable length of the spring finger 86 within the bore 80, and the value of this deflectable length may be predetermined rather precisely. With the spring 86 secured in the foregoing way, it is necessary to physically remove the screw 98 in order to tamper with the spring 86 and the resistance exerted by the spring 86 against the yarn passing through the conduit means 68.

The eccentric distance between the axes 82, 84 is also important with respect to the mounting of the leaf spring 86. The eccentricity of the bores 76, 80 not only establishes an offset surface or shoulder 99 through which the leaf spring 86 may project without entanglement with crimped yarn, but also permits the cantilever support of the leaf spring 86 to be moved farther from the crimped yarn. By this positioning of the cantilever support the maximum bending stresses in the leaf spring are reduced since a greater spring length is available to accommodate the spring deflection necessary to pass the crimped yarn.

The particular feature which is characteristic of the present invention is a longitudinal slot 100 in the housing 78 (see FIG. 6), underlying the rounded end 88 of the spring 86 and extending longitudinally from a position 102 upstream of the spring 86 to the outlet end 90. The slot 100 is generally positioned in the surface portion 85 of the second bore 80, extends through the wall of the restrictor body 78 to outside surface thereof and has a width slightly greater than the width of crimped yarn. Its purpose is to provide a path along which yarn may move rearwardly through the crimper outlet assembly when necessary, without causing damage to the spring 86.

In operation, steam is supplied through the conduit 54 (see FIG. 2*b*) to the central annular recess 48 (see FIG. 2*a*) in the manifold block 44. The steam then passes through the radial ports 42 into a plenum chamber defined between the distal end of the orifice plug 31 and the enlarged bore 26. When the steam passes through the annular orifice defined between the frustoconical surfaces 32, 34, it is accelerated as a high velocity jet and develops a low pressure area in the bore 24 adjacent the discharge end of the channel 36. The accelerated steam then travels down the bore 24 and a substantial portion thereof passes through the foraminous sheet 62 and exhausts through the channel 60 of the exhaust portion 58.

The steam jet in the bore 24 at the end of the orifice plug 31 causes the multi-filament yarn of synthetic resinous material, as yet untexturized, to be continuously pulled in through the yarn inlet 36. When the yarn reaches the bore 24, the high velocity jet of steam continuously thrusts the yarn against the foraminous surface 62.

As the untexturized yarn hits and rebounds from the foraminous surface 62, each longitudinal increment of each yarn filament is crimped in a random fashion. Then, the bounce crimped yarn continually bounces and rebounds from the screen toward the discharge opening 64. From the discharge opening, the boune crimped multi-filament yarn passes into the straight tubular conduit 68 and then into the restrictor assembly 72.

The leaf spring 86 impedes movement of the bounce crimped yarn through the straight tubular conduit means 68, causing accumulation and consolidation of the yarn therein. In this manner, the filament crimping effected by the foraminous surface 62 (see FIG. 2*a*) is allowed to become at least partially set before the yarn leaves the restrictor assembly 72 and excessive blooming of the yarn of highly crimped filaments is avoided.

As the multi-filament yarn passes from the second end of the straight tubular conduit 68 (see FIG. 5), it enters the enlarged bore 80 of the discharge restrictor assembly 72.

The packed bounce crimped yarn causes the leaf spring 86 to deflect to allow passage of the yarn. Deflection of the spring causes a corresponding change in the cross-sectional configuration of this yarn accumulation. The larger diameter of the second bore 80 as compared to the first bore 76 facilitates this cross-sectional change in the yarn accumulation by presenting a larger volume for the crimped yarn to occupy.

During operation of the bounce crimping apparatus, feed yarn occasionally will get caught on the surface of one roll, as for example, the last feed roll 14 (see FIG. 1). In this instance, the crimped yarn in the outlet assembly can be pulled back through the bounce crimper head 20 toward the roll 14. This improper operation can irreparably damage the leaf spring 86 if the yarn cannot more freely pass the spring. It has been found that this problem can be avoided by the longitudinal slot 100 underlying the rounded end 88 of the spring 86. As the yarn is placed under tension during its reversed movement, the yarn portion located adjacent the slot can pass freely through the slot to avoid further contact with the spring finger 86. Hence, the yarn will not become caught on the spring and will not injure it.

It should now be apparent that there has been provided in accordance with the present invention a bounce crimping device having an improved outlet apparatus which enhances the performance capabilities of the equipment. It is expressly intended that all modifications, variations, substitutions and equivalents which fall within the spirit and scope of the invention as defined in the appended claims be embraced thereby.

What is claimed is:

1. In apparatus for bounce crimping a multi-filament yarn of synthetic resinous material having draw rolls for delivering the yarn to be crimped at a predetermined speed;

a yarn texturizing housing having a yarn inlet for receiving an elongated multi-filament yarn, a fluid outlet aligned with the yarn inlet through which fluid is exhausted from the housing, a fluid inlet for receiving a yarn forwarding fluid, a channel extending between the yarn inlet and the fluid outlet through which yarn and the fluid pass during texturizing, and a lateral yarn outlet communicating with the channel and defining an exit from the channel for texturized yarn;

means for supplying a heated compressible fluid, communicating with the channel and operable to draw the multi-filament yarn into the yarn inlet of the housing; and a foraminous surface positioned across the channel between the lateral yarn outlet and the fluid outlet, the heated fluid further serving to hurl the yarn against the foraminous surface to axially compress and crimp the yarn filaments and bounce the multi-filament yarn through the lateral yarn outlet;

an improvement comprising an outlet means operatively connected to said lateral yarn outlet for consolidating the yarn issuing therefrom, said outlet means including:

a restrictor assembly having a longitudinal bore and an inclined spring finger partially blocking the bore to provide a resistance to yarn movement out of the discharge end of said bore, said restrictor assembly also being provided with means for bypassing the spring finger and freely permitting rearward yarn movement past the spring finger when the yarn is pulled rearwardly by said draw rolls, said means for bypassing including a longitudinal slot positioned opposite the spring finger and extending from a first position upstream of the spring finger to a second position downstream of the spring finger.

2. The bounce crimper of claim 1, wherein said spring finger is inclined toward the axis of said bore in the direction of normal yarn discharge from said bore and wherein said slot extends on both sides of the location of the end of said spring finger.

3. In a restrictor assembly for attachment to the outer end of a yarn outlet conduit on a crimper means subject to occasional rearward yarn movement, said assembly comprising a housing having a longitudinal bore therein through which yarn exiting from said outlet conduit may be pushed to discharge the yarn from said restrictor assembly, said housing also being provided with a narrow slot intersecting said bore with the length of said slot extending generally transverse to the axis of said bore, a spring finger having a substantially flat configuration in its unstrained configuration and extending through said narrow slot into said bore so that the portion of the spring finger within the bore will be deflected as the yarn is pushed along said bore to apply a back pressure to the moving yarn, and means for attaching said spring finger to said housing so as to fix at predetermined values the inclination and deflectable length of said spring finger, the improvement which comprises means for bypassing the spring finger and freely permitting rearward yarn movement past the spring finger, said means positioned in said housing opposite the free end of said spring finger and extending both upstream and downstream of said spring finger.

4. A restrictor assembly according to claim 3, wherein said means for permitting rearward yarn movement is a longitudinal slot narrower than the consolidated body of yarn normally discharging from said bore but wider than a tensioned segment of said yarn.

* * * * *